US010260465B2

(12) United States Patent
Hidaka et al.

(10) Patent No.: US 10,260,465 B2
(45) Date of Patent: Apr. 16, 2019

(54) FUEL PUMP AND CONTROL METHOD THEREFOR INCLUDING CONTROL OF ROTATION SPEED OF IMPELLER

(71) Applicant: DENSO CORPORATION, Kariya, Aichi-pref. (JP)

(72) Inventors: Yuuji Hidaka, Kariya (JP); Masaya Ootake, Kariya (JP); Kiyoshi Nagata, Kariya (JP)

(73) Assignee: DENSO CORPORATION, Kariya (JP)

( * ) Notice: Subject to any disclaimer, the term of this patent is extended or adjusted under 35 U.S.C. 154(b) by 356 days.

(21) Appl. No.: 14/914,388

(22) PCT Filed: Aug. 21, 2014

(86) PCT No.: PCT/JP2014/004291
§ 371 (c)(1),
(2) Date: Feb. 25, 2016

(87) PCT Pub. No.: WO2015/029390
PCT Pub. Date: Mar. 5, 2015

(65) Prior Publication Data

US 2016/0208747 A1 Jul. 21, 2016

(30) Foreign Application Priority Data

Aug. 30, 2013 (JP) ..... 2013-179249

(51) Int. Cl.
*F02M 37/08* (2006.01)
*F02M 37/20* (2006.01)
(Continued)

(52) U.S. Cl.
CPC ..... *F02M 37/08* (2013.01); *F02D 33/003* (2013.01); *F02D 41/0025* (2013.01);
(Continued)

(58) Field of Classification Search
CPC ..... F02M 37/08; F02M 37/10; F02M 37/20; F02M 2037/085; F02M 55/007;
(Continued)

(56) References Cited

U.S. PATENT DOCUMENTS 5,662,455 A 9/1997 Iwata et al.
2003/0230249 A1* 12/2003 Yamaoka ..... F02M 37/20 123/1 A (Continued)

FOREIGN PATENT DOCUMENTS

JP 5-18388 1/1993
JP 11-218059 8/1999

(Continued)

OTHER PUBLICATIONS

International Search Report for PCT/JP2014/004291 dated Nov. 18, 2014, three pages.

(Continued)

*Primary Examiner* — Dominick L Plakkoottam
*Assistant Examiner* — Stephen A Mick
(74) *Attorney, Agent, or Firm* — Nixon & Vanderhye P.C.

(57) ABSTRACT

An ECU of a fuel pump executes a feedback control to drive a motor part and sets a rotation speed of an impeller to become a rotation speed corresponding to the target fuel pressure. The ECU detects whether a vapor is generated in a fuel of a pump chamber of the fuel pump, based on a fuel pressure detected by a pressure sensor. When a generation of the vapor is detected, the ECU sets a rotation speed of the impeller to be higher than the rotation speed under a normal control for a predetermined time with a result that the vapor in the pump chamber and a fuel flow channel is discharged into a vapor discharge hole. Thus, the vapor of the pump chamber is discharged from the vapor discharge hole to an outside of the fuel pump.

14 Claims, 15 Drawing Sheets

(51) Int. Cl.

| | |
|---|---|
| ***F02M 37/10*** | (2006.01) |
| ***F02D 33/00*** | (2006.01) |
| ***F02D 41/30*** | (2006.01) |
| ***F02D 41/00*** | (2006.01) |
| ***F04D 3/00*** | (2006.01) |
| ***F04D 13/06*** | (2006.01) |
| ***F04D 15/00*** | (2006.01) |
| ***F04D 29/18*** | (2006.01) |
| ***F04D 29/52*** | (2006.01) |

(52) U.S. Cl.
CPC ..... *F02D 41/3082* (2013.01); *F02M 37/10* (2013.01); *F02M 37/20* (2013.01); *F04D 3/005* (2013.01); *F04D 13/06* (2013.01); *F04D 15/0066* (2013.01); *F04D 29/181* (2013.01); *F04D 29/528* (2013.01); *F02D 2200/0602* (2013.01); *F02D 2250/02* (2013.01); *F02M 2037/085* (2013.01)

(58) Field of Classification Search
CPC .... F04D 29/528; F04D 15/0066; F04D 13/06; F04D 3/005; F04D 29/181; F04D 9/001–9/003; F04D 9/00; F04D 9/007; F04D 9/02; F04D 29/406; F04D 27/004; F02D 41/0025; F02D 41/3082; F02D 33/003; F02D 2250/02; F02D 2200/0602; F02D 2041/141; F04B 49/06; F04B 49/20; F04B 2205/503; F04B 53/06
USPC ..... 417/44.2
See application file for complete search history.

(56) References Cited

U.S. PATENT DOCUMENTS

| | | | | |
|---|---|---|---|---|
| 2004/0191096 | A1* | 9/2004 | Koyama | F04D 5/002 417/423.14 |
| 2010/0034674 | A1* | 2/2010 | Oota | F02M 37/08 417/410.1 |
| 2010/0266436 | A1* | 10/2010 | Kobayashi | F02M 37/08 418/75 |
| 2011/0231082 | A1* | 9/2011 | Saruwatari | F02D 41/0042 701/104 |

FOREIGN PATENT DOCUMENTS

| | | |
|---|---|---|
| JP | 2005-76568 | 3/2005 |
| JP | 2005-120834 | 5/2005 |
| JP | 2007-126986 | 5/2007 |
| JP | 2008-274820 | 11/2008 |

OTHER PUBLICATIONS

Written Opinion of the ISA for PCT/JP2014/004291 dated Nov. 18, 2014, four pages.

* cited by examiner

FUEL PUMP AND CONTROL METHOD THEREFOR INCLUDING CONTROL OF ROTATION SPEED OF IMPELLER

CROSS REFERENCE TO RELATED APPLICATION

This application is the U.S. national phase of International Application No. PCT/JP2014/004291 filed Aug. 21, 2014 which designated the U.S. and claims priority to Japanese Patent Application No. 2013-179249 filed on Aug. 30, 2013, the entire contents of each of which are hereby incorporated by reference.

TECHNICAL FIELD

The present disclosure relates to a fuel pump that supplies a fuel in a fuel tank of a vehicle to an internal combustion engine, and a control method therefor.

BACKGROUND ART

In recent years, the vehicle is used under environments of a high temperature and a low pressure, and a fuel high in vapor pressure such as an alcohol mixed fuel is used for the fuel, potentially resulting in a state where vapor is likely to be generated in the fuel to be supplied from the fuel tank into the internal combustion engine. In this case, the vapor corresponds to air bubbles.

Patent Literature 1 discloses a technique in which when vapor is generated in the fuel flowing in a fuel pipe that connects the fuel pump and the internal combustion engine, a target fuel pressure of the fuel discharged by the fuel pump is set to be higher to prevent vapor lock from being generated in the fuel pipe.

Incidentally, in recent years, in order to reduce a power consumption of the vehicle, a variable fuel pressure system that pumps a fuel corresponding to a fuel pressure and a flow rate required by the internal combustion engine into the internal combustion engine from the fuel pump may be employed as a control system of a fuel supply system. A stable discharge at a low flow rate is required for the fuel pump used for the system.

However, when vapor is generated in the fuel in a pump chamber that boosts a fuel pressure in the fuel pump when the fuel pump discharges the fuel at the low flow rate, it is difficult to discharge the vapor from the pump chamber together with the fuel.

In this case, even when the target fuel pressure of the fuel discharged by the fuel pump is set to be higher through the technique disclosed in Patent Literature 1, it is difficult to discharge the vapor from the pump chamber by the rotation of an impeller driven according to the higher target fuel pressure under control.

If a large amount of vapor is stored in the pump chamber of the fuel pump, there is a risk that the fuel pump is vapor-locked, and the fuel is not discharged.

PRIOR ART LITERATURES

Patent Literature

Patent Literature 1: JP2005-76568A

SUMMARY OF INVENTION

The present disclosure has been made in view of the above circumstances, and aims at providing a fuel pump which is capable of preventing vapor locking of a pump chamber that boosts a fuel pressure.

According to a first aspect of the present disclosure, in a fuel pump increasing a pressure of a fuel in a pump chamber by a rotation of an impeller, when a vapor is generated in the pump chamber, a rotation speed of the impeller is set to be higher than the rotation speed under a normal control for a predetermined time with a result that the vapor in the pump chamber is discharged into a vapor discharge hole.

Thus, when the vapor is generated in the pump chamber, a control of the fuel pump switches from the normal control to a control discharging the vapor into a vapor discharge hole. Thus, the vapor in the pump chamber is surely discharged to an outside of the fuel pump from the vapor discharge hole. Therefore, the fuel pump can discharge a required flow rate without any vapor lock.

According to a second aspect of the present disclosure, in a control method controlling a drive of the fuel pump, when a generation of the vapor is detected, the rotation speed of the impeller is set to be higher than the rotation speed corresponding to a target fuel pressure under the normal control for a predetermined time with a result that the vapor in the pump chamber and a fuel flow channel is discharged into the vapor discharge hole.

Thus, the fuel pump can prevent a vapor lock.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Hereinafter, embodiments of the present disclosure will be described with reference to the drawings.

(First Embodiment)

A first embodiment of the present disclosure is illustrated in FIGS. 1 to 15. A fuel pump 1 according to this embodiment is used for a fuel supply system in a variable fuel pressure system, and configured to pump a fuel in a fuel tank 2 into an internal combustion engine (ICE) 4 through a fuel pipe 3.

Figure 1:
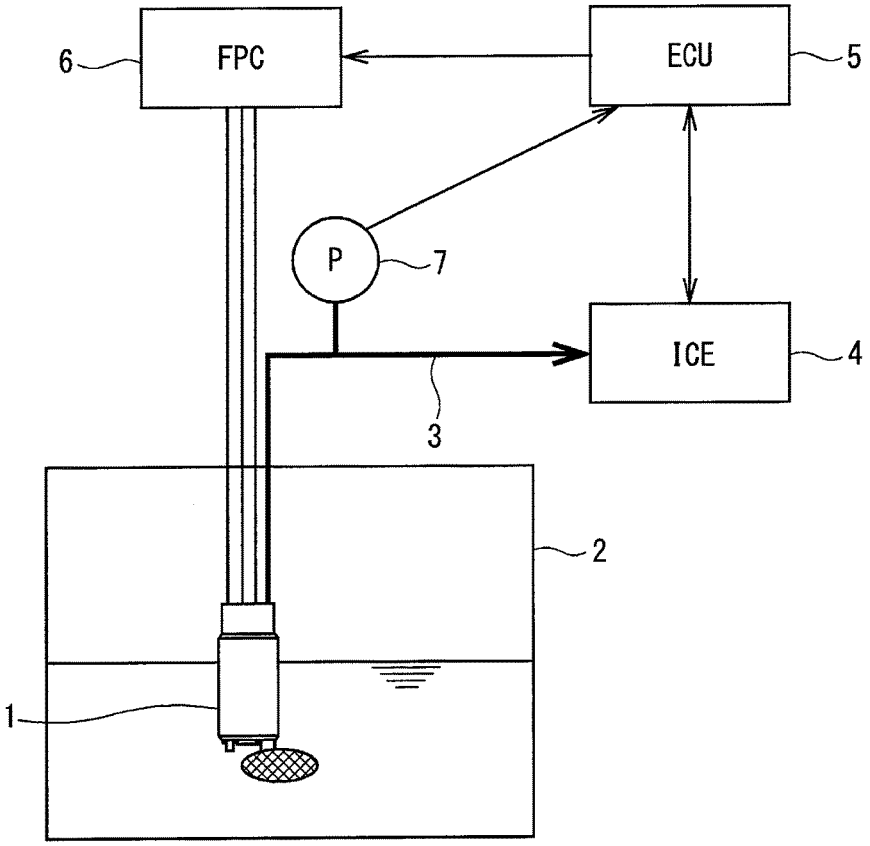
FIG. 1 is a configuration diagram of a fuel supply system using a fuel pump according to a first embodiment of the present disclosure.

As illustrated in FIG. 1, in the control system, an electronic control unit (ECU) 5 for a vehicle detects a rotation speed of an impeller corresponding to a fuel pressure and a flow rate required by the internal combustion engine 4, and transmits a command value of the rotation speed to a controller (FPC) 6 of the fuel pump 1. The FPC 6 supplies a three-phase AC corresponding to the command value of the ECU 5 to a motor of the fuel pump 1.

A pressure of the fuel discharged into the fuel pipe 3 from the fuel pump 1 is detected by a pressure sensor (P) 7, and a signal of the pressure sensor 7 is transmitted to the ECU 5. In this case, the pressure of the fuel is referred to as the fuel pressure. The ECU 5 executes a feedback control on the fuel pump 1 through the FPC 6 so that the fuel pressure detected by the pressure sensor 7 matches a target fuel pressure.

When it is detected according to the signal of the pressure sensor 7 that vapor is generated in a pump chamber of the fuel pump 1, the ECU 5 according to this embodiment performs a control discharging vapor into a vapor discharge hole under a predetermined feed forward control. In this case, the vapor corresponds to air bubbles.

First, an overall configuration of the fuel pump 1 will be described.

Figure 2:
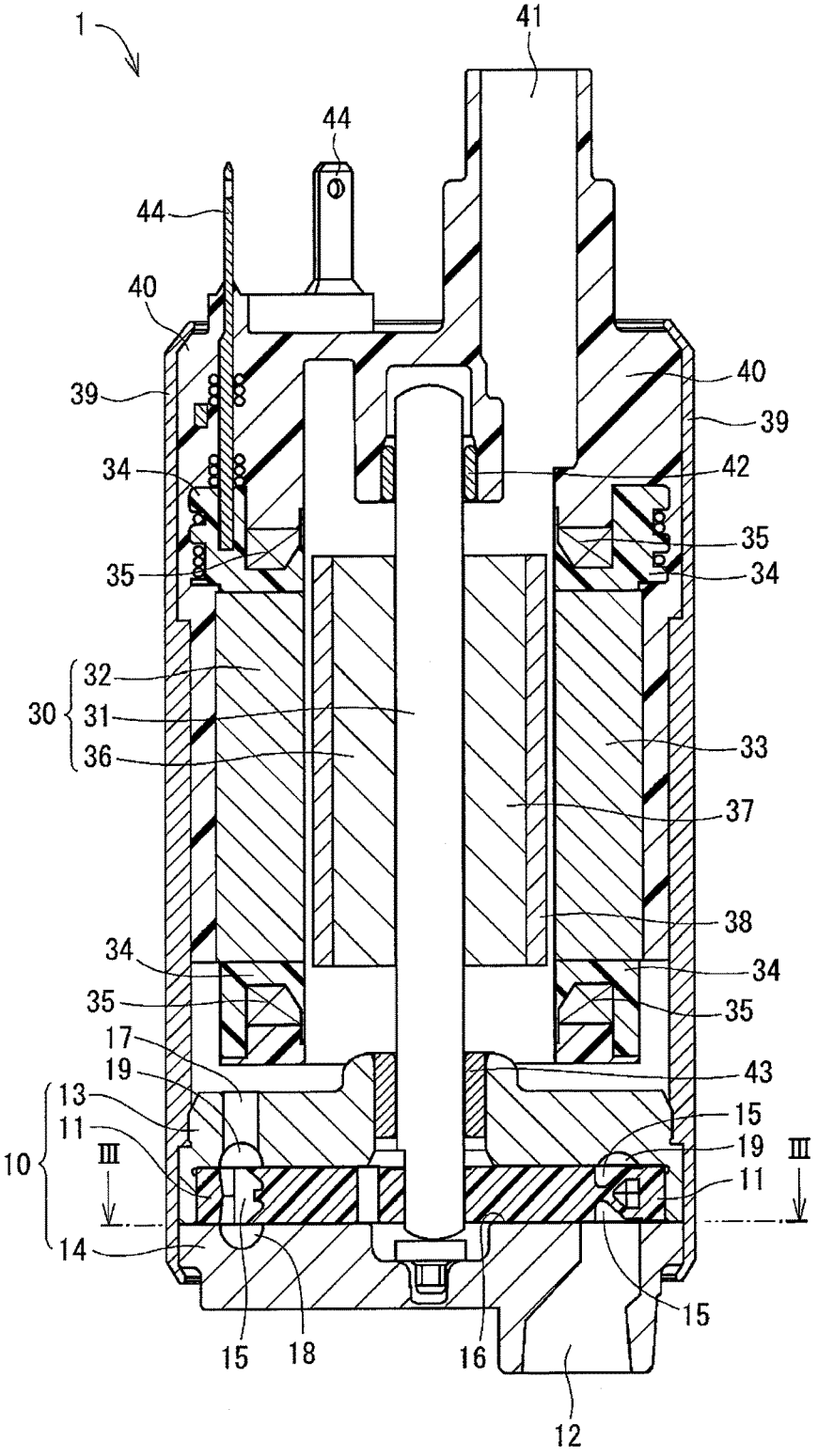
FIG. 2 is a cross-sectional view of the fuel pump according to the first embodiment.

As illustrated in FIG. 2, the fuel pump 1 includes a pump part 10, a motor part 30, a housing 39, and a motor cover 40. The fuel pump 1 draws a fuel from an intake port 12 shown in a lower portion of FIG. 2 with the rotation of an impeller 11 provided in the pump part 10, boosts a pressure of the fuel, and discharges the fuel from a fuel discharge pipe 41 shown in an upper portion of FIG. 2.

The pump part 10 includes the impeller 11, an upper casing 13, and a lower casing 14. In this embodiment, the upper casing 13 and the lower casing 14 correspond to a casing.

The impeller 11 is a disc shape, and has multiple vane grooves 15 arrayed in a peripheral direction. The impeller 11 is fixed to a shaft 31 of the motor part 30, and rotates together with the shaft 31.

A pump chamber 16 that rotatably houses the impeller 11 is arranged between the upper casing 13 and the lower casing 14.

The lower casing 14 has the intake port 12 introducing the fuel from an outside of the fuel pump 1 into the pump chamber 16. In other words, the lower casing 14 has the intake port 12 introducing the fuel from the outside of the lower casing 14 into the pump chamber 16.

The upper casing 13 has a discharge port 17 that discharges the fuel from the pump chamber 16 toward the motor part 30. In other words, the upper casing 13 has the discharge port 17 discharging the fuel from the pump chamber 16 toward an outside of the upper casing 13.

Figure 3:
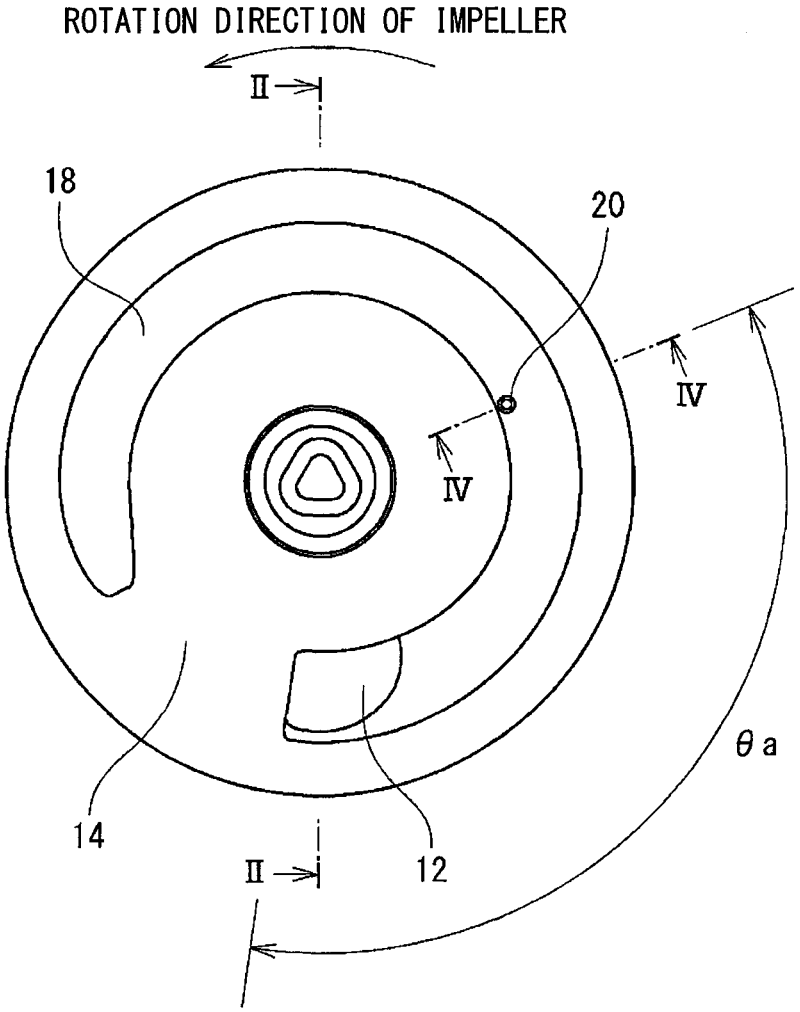
FIG. 3 is a diagram illustrating only a lower casing viewed along a line of FIG. 2.

As illustrated in FIG. 3, the lower casing 14 has a lower fuel flow channel 18 defined in an annular shape corresponding to the vane grooves 15 of the impeller 11 so as to extend from the intake port 12 to the discharge port 17. The lower fuel flow channel 18 is a substantially C-shape. The lower casing 14 has a vapor discharge hole 20 through which the fuel as well as vapor contained in the fuel can be discharged from the pump chamber 16 and the lower fuel flow channel 18 toward the outside of the fuel pump 1.

As illustrated in FIG. 2, as with the lower casing 14, the upper casing 13 has an upper fuel flow channel 19 defined in an annular shape corresponding to the vane grooves 15 of the impeller 11 so as to extend from the intake port 12 to the discharge port 17. The upper fuel flow channel 19 of the upper casing 13 and the lower fuel flow channel 18 of the lower casing 14 communicate with the pump chamber 16.

When the impeller 11 rotates together with the shaft 31 of the motor part 30, the fuel is drawn from the intake port 12 into the pump chamber 16, the lower fuel flow channel 18, and the upper fuel flow channel 19. With the rotation of the impeller 11, the fuel flows between the vane grooves 15 and the lower fuel flow channel 18, the upper fuel flow channel 19 in a spiral swirling flow. The fuel is boosted in pressure toward the discharge port 17 from the intake port 12, and discharged from the discharge port 17.

The motor part 30 is a brushless motor, and includes a stator 32, a rotor 36, and the shaft 31.

The stator 32 is a cylindrical shape, and includes a stator core 33, an insulator 34, and a winding wire 35. The stator core 33 is made of a magnetic material such as iron. The insulator 34 is configured to mold the stator core 33 with resin. The winding wire 35 is wound around the insulator 34 to configure a three-phase winding. The insulator 34 around which the winding wire 35 is wound is molded integrally with the motor cover 40 with resin. Therefore, the stator 32 is provided integrally with the motor cover 40.

The rotor 36 is rotatably housed inside of the stator 32. In the rotor 36, a magnet 38 is fixed around an iron core 37. The magnet 38 has N poles and S poles alternately arranged in a peripheral direction.

The shaft 31 is press-fitted in the center of the rotor 36, and rotates together with the rotor 36. The shaft 31 has a first end rotatably supported by a first bearing 42 disposed in the motor cover 40, and a second end rotatably supported by a second bearing 43 disposed in the upper casing 13.

When a three-phase power is supplied to the winding wires 35 of the respective phases of the stator 32 from terminals 44 of a U-phase, a V-phase, and a W-phase disposed in the motor cover 40, a rotating magnetic field is generated in the stator 32, and the rotor 36 and the shaft 31 rotate.

The housing 39 is a cylindrical shape, and a first end of the housing 39 in an axial direction is bent in a radially inner direction to fix the motor cover 40 and the motor part 30. Two ends of the housing 39 in the axial direction are bent in the radially inner direction to fix the lower casing 14 and the upper casing 13.

The motor cover 40 has the fuel discharge pipe 41 projected upward in FIG. 1. The fuel of the pressure boosted by the pump part 10 passes through a gap between the stator 32 and the rotor 36 in the motor part 30, and is discharged from the fuel discharge pipe 41.

Subsequently, the vapor discharge hole 20 defined in the lower fuel flow channel 18 of the lower casing 14 will be described.

As illustrated in FIG. 3, the vapor discharge hole 20 is disposed in a state where an angle θa of the vapor discharge hole 20 ranges from about 110 degrees to 130 degrees when a position of the intake port 12 is set to 0 degrees. Vapor may be generated in the fuel drawn into the pump chamber 16 from the intake port 12 due to an intake negative pressure. The vapor discharge hole 20 discharges the vapor generated in the vicinity of the intake port 12 toward the outside of the fuel pump 1.

The pressure of the fuel introduced into the lower fuel flow channel 18 and the pump chamber 16 due to the negative pressure of the intake port 12 is gradually boosted, and reaches dozens kPa in the vicinity of the vapor discharge hole 20. Thus, the fuel in the lower fuel flow channel 18 is discharged from the vapor discharge hole 20 toward the outside of the fuel pump 1.

Figure 4:
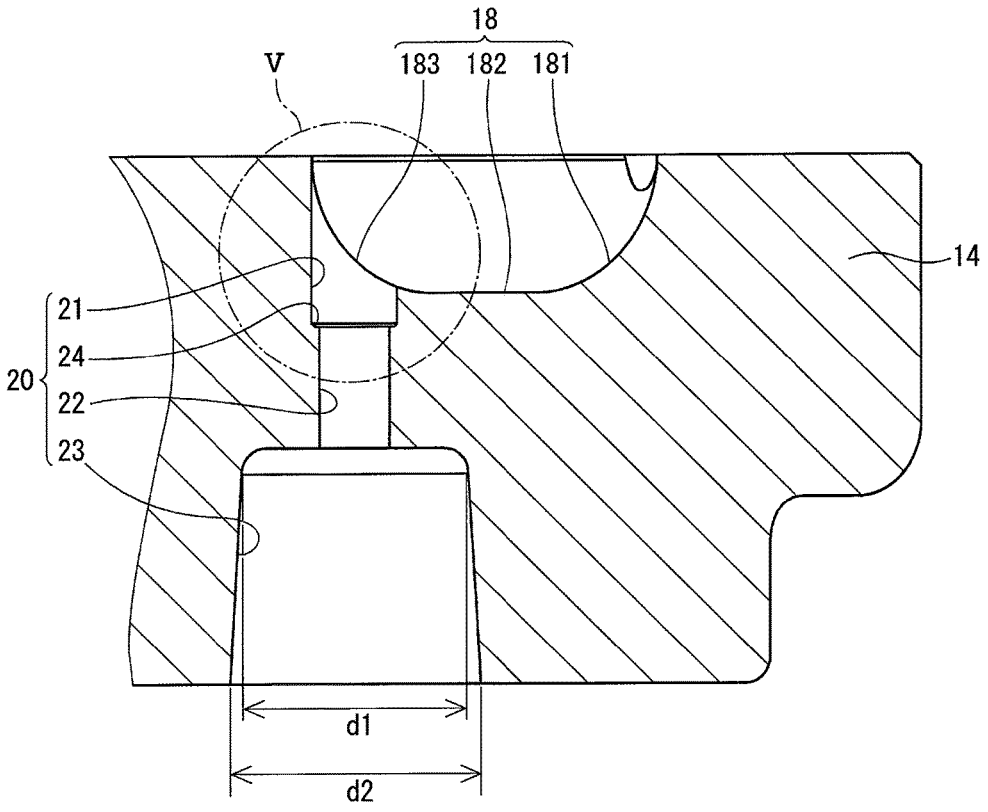
FIG. 4 is a cross-sectional view of a portion taken along a line IV-IV in FIG. 3.

As illustrated in FIG. 4, the lower fuel flow channel 18 has an outer curved part 181, a flat part 182, and an inner curved part 183 from a radially outer side toward a radially inner side. The outer curved part 181 is a portion of a surface of the lower fuel flow channel 18 and has a depth becoming gradually deeper from the radially outer side toward the radially inner side. The flat part 182 is a portion of a surface of the lower fuel flow channel 18 and has a depth that is kept constant. The inner curved part 183 is a portion of a surface of the lower fuel flow channel 18 and has a depth that is gradually shallower from the flat part 182 toward the radially inner side. The vapor discharge hole 20 is connected to the inner curved part 183 of the lower fuel flow channel 18.

Since a centrifugal force caused by the rotation of the impeller 11 acts on the fuel flowing in the lower fuel flow channel 18, a pressure of the fuel flowing in the radially outer side of the lower fuel flow channel 18 is high. Since the vapor contained in the fuel is smaller in mass than the fuel, the vapor flows in the radially inner side of the lower fuel flow channel 18. Therefore, with the connection of the vapor discharge hole 20 to the inner curved part 183 of the lower fuel flow channel 18, the vapor flowing in the lower fuel flow channel 18 can be surely introduced into the vapor discharge hole 20.

The vapor discharge hole 20 has a first flow path 21, a second flow path 22, a third flow path 23, and a tapered part 24. All of those components are coaxial with each other.

The first flow path 21 is connected to the inner curved part 183 of the lower fuel flow channel 18, and communicates with the lower fuel flow channel 18. The first flow path 21 prevents the fuel from being separated from an inner wall of the vapor discharge hole 20 when the fuel flows into the vapor discharge hole 20 from the lower fuel flow channel 18.

The second flow path 22 has an inner diameter smaller than that of the first flow path 21, and communicates with an end of the first flow path 21 opposite to the fuel flow path. With the setting of an inner diameter and a length of the second flow path 22, a flow rate of the fuel flowing in the vapor discharge hole 20 is adjusted.

Figure 5:
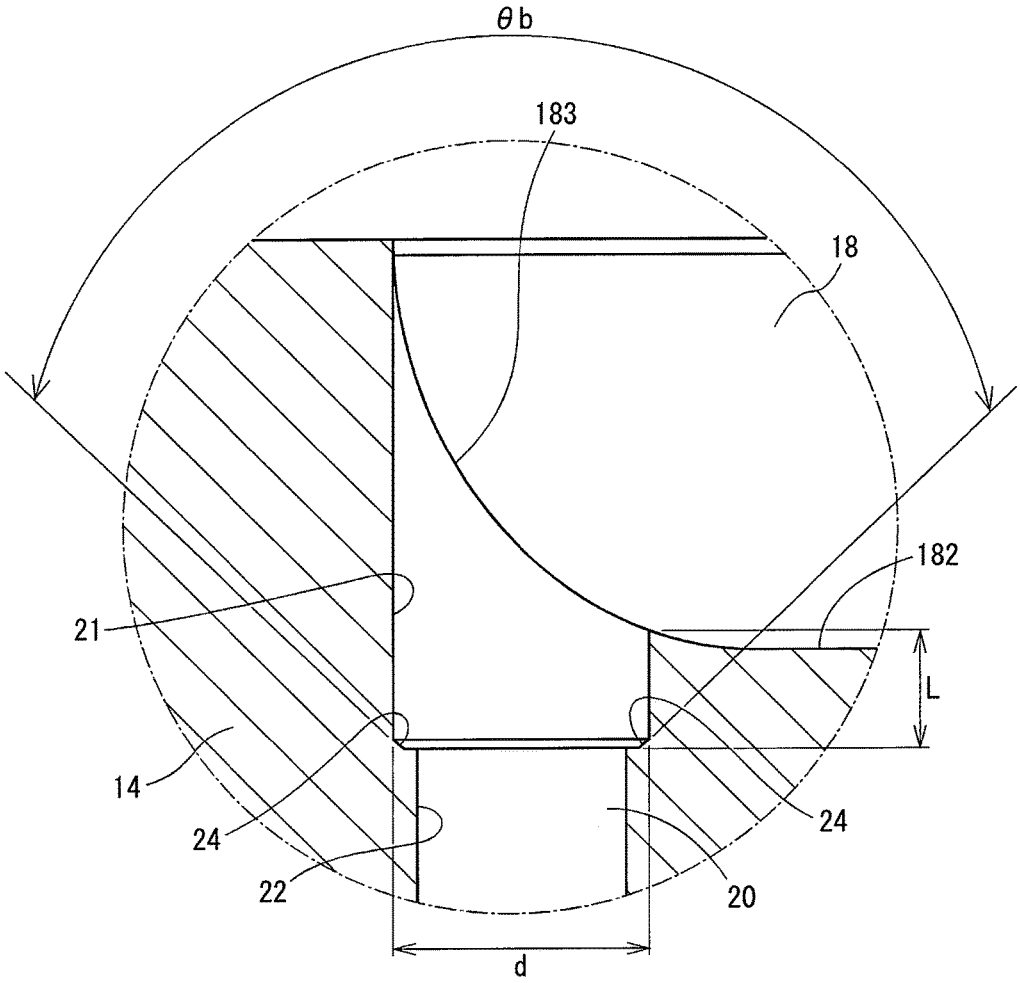
FIG. 5 is an enlarged view of a portion V in FIG. 4.

The tapered part 24 is disposed in a connection portion of the first flow path 21 and the second flow path 22, and prevents a vortex flow from being generated in the fuel flowing in a step between the first flow path 21 and the second flow path 22. The tapered part 24 is disposed annularly on a radially outer side of the step disposed between the first flow path 21 and the second flow path 22. As illustrated in FIG. 5, the tapered part 24 is provided to have an interior angle θb that is equal to or lower than 120 degrees. When the interior angle is larger than 120 degrees, the vortex flow is likely to be generated in the fuel flowing in the tapered part 24.

As illustrated in FIG. 4, the third flow path 23 has an inner diameter larger than that of the second flow path 22, and communicates with an end of the second flow path 22 opposite to the first flow path. The third flow path 23 is configured to adjust a length of the second flow path 22. An inner wall of the third flow path 23 is substantially in parallel to an inner wall of the second flow path 22. An inner diameter d1 of the third flow path 23 on the second flow path side is slightly smaller than an inner diameter d2 on the side opposite to the second flow path. In other words, the inner wall of the third flow path 23 is tapered to provide a draft through which a mold that defines the third flow path 23 is removed from a material of the lower casing 14 in a case where the lower casing 14 is being formed. As a result, it is possible to enhance the workability of the third flow path 23. In forming the vapor discharge hole 20, burr generated in a connection portion between the second flow path 22 and the third flow path 23 can be easily removed.

As illustrated in FIG. 5, a distance from a connection position of the lower fuel flow channel 18 and the first flow path 21 to a connection position of the first flow path 21 and the second flow path 22 is L, and the inner diameter of the first flow path 21 is d. In this case, the distance is also called a length of the first flow path 21. It is preferable that a relationship between the length L of the first flow path 21 and the inner diameter d satisfies $2 \leq d/L \leq 5$.

Figure 6:
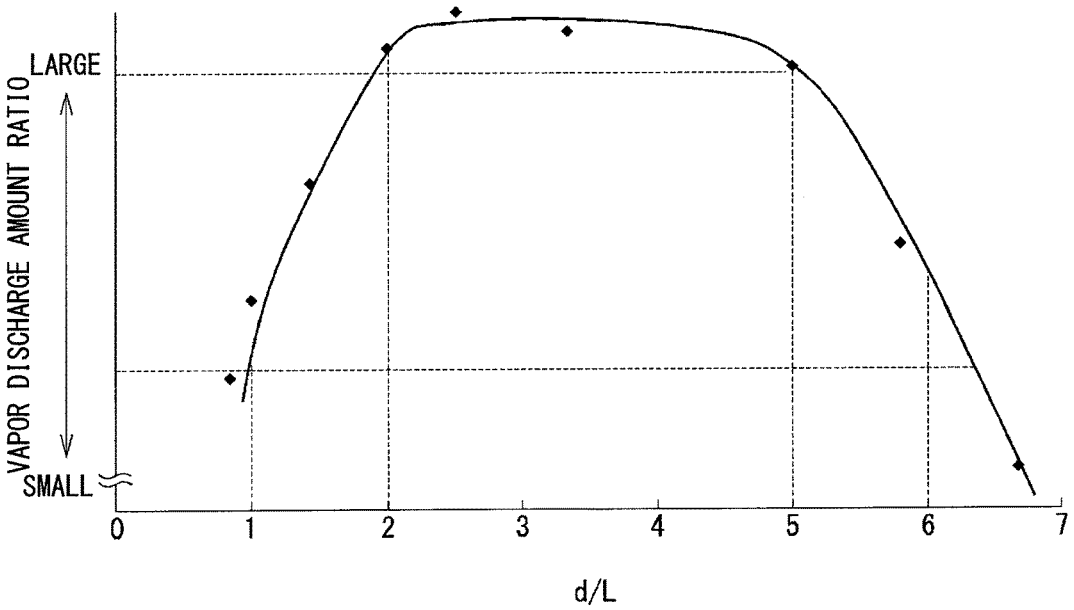
FIG. 6 is a characteristic diagram of a shape of a first flow path of a vapor discharge hole and a vapor discharge amount ratio.

FIG. 6 illustrates a relationship between d/L and a vapor discharge amount ratio when an impeller rotation speed that is the rotation speed of the impeller 11 is set to 3000 rpm to 10000 rpm which are general as the fuel pump 1.

In this case, when d/L is in a range from 1 to 6 ($1 \leq d/L \leq 6$), the vapor discharge amount ratio is higher than or equal to 96.5%. When d/L is in a range from 2 to 5 ($2 \leq d/L \leq 5$), the vapor discharge amount ratio is higher than or equal to 99%. As described above, with the adjustment of the relationship between the length L of the first flow path 21 and the inner diameter d thereof, a shape of the vapor discharge hole 20 can be adjusted to an angle of the fuel flowing from the first flow path 21 into the second flow path 22. With the above configuration, vapor discharged from the lower fuel flow channel 18 toward the vapor discharge hole 20 together with the fuel can be increased.

Subsequently, a fuel flow in a vapor discharge hole 200 in a comparative example, and a fuel flow in the vapor discharge hole 20 according to the first embodiment will be described in comparison.

Figure 7:
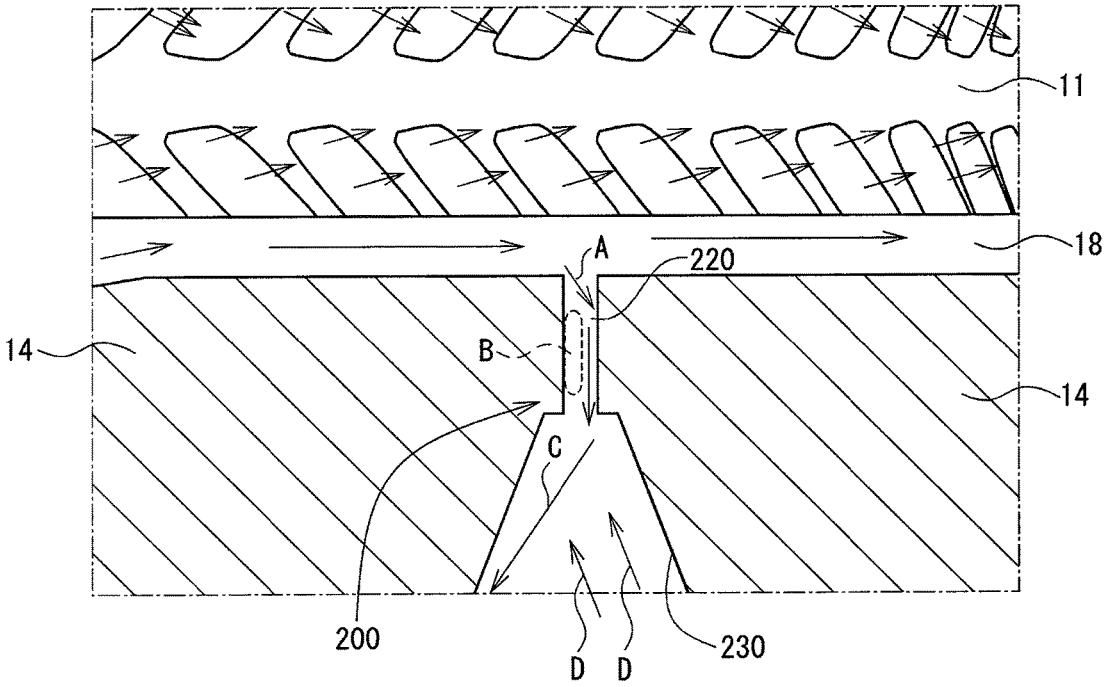
FIG. 7 is a diagram illustrating a fuel flow of the vapor discharge hole in a comparative example.

As illustrated in FIG. 7, the vapor discharge hole 200 in the comparative example does not have the first flow path 21 and the tapered part 24 because a second flow path 220 is connected directly to the lower fuel flow channel 18. A tapered angle of a third flow path 230 in the comparative example is defined to be larger than a tapered angle of the third flow path 23 in the first embodiment. In this case, the fuel flowing into the vapor discharge hole from the lower fuel flow channel 18 flows away from the inner wall of the vapor discharge hole 200 on an upstream side as indicated by an arrow A. Therefore, a vortex flow is generated in the vicinity of the inner wall of the vapor discharge hole 200 on the upstream side as indicated by a dashed line B, and a fuel pressure is reduced. Thus, when vapor is generated from the vortex flow, the vapor discharge amount discharged from the lower fuel flow channel 18 is reduced by the volume of vapor.

As indicated by an arrow C, in the vapor discharge hole 200 in the comparative example, the fuel flows in only a part of the third flow path 230. As indicated by an arrow D, a flow drawing the fuel from the outside of the third flow path 230 is generated in the other part of the third flow path 230. As a result, in the vapor discharge hole 200 in the comparative example, the vapor discharge amount discharged from the lower fuel flow channel 18 is reduced.

Figure 8:
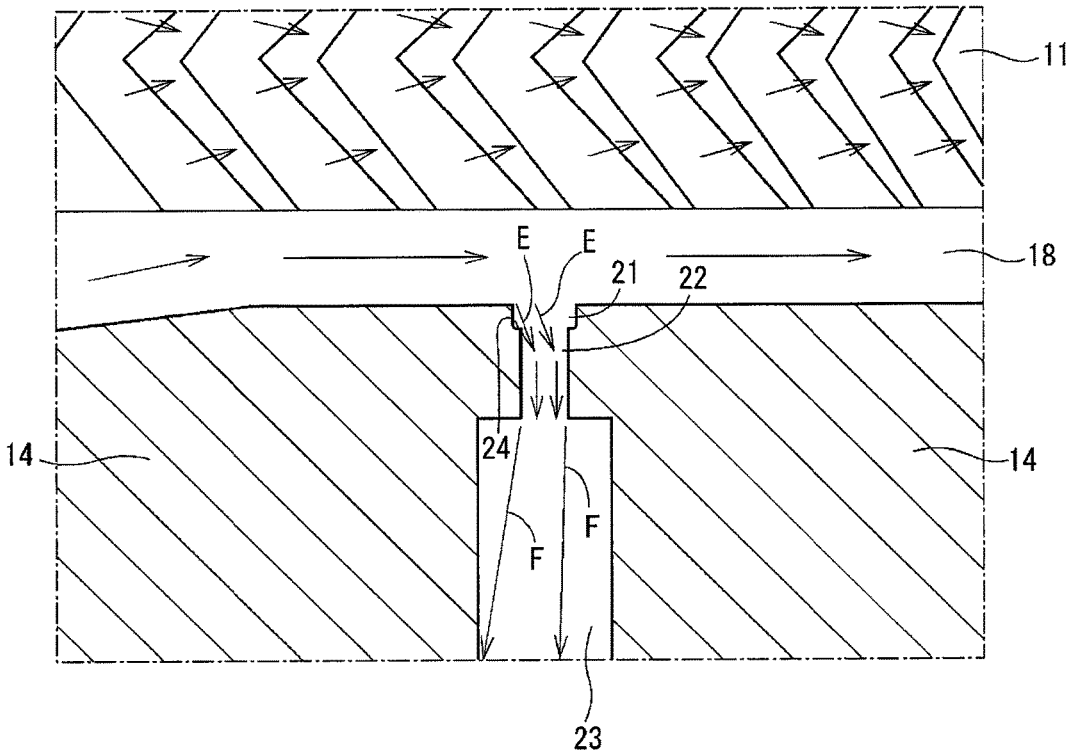
FIG. 8 is an analysis diagram illustrating a fuel flow in a vapor discharge hole according to the first embodiment.

On the contrary, as indicated by an arrow E in FIG. 8, in the first embodiment, the fuel flowing from the lower fuel flow channel 18 into the vapor discharge hole 20 flows along the inner walls of the first flow path 21, the tapered part 24, and the upstream side of the second flow path 22 without being away from the inner walls. Thus, since no vortex flow is generated in the vicinity of the inner wall of the upstream side of the vapor discharge hole 20, the vapor discharge amount discharged from the lower fuel flow channel 18 increases as compared with the vapor discharge hole 200 in the comparative example.

As indicated by an arrow F, the third flow path 23 of the vapor discharge hole 20 in the first embodiment can discharge the fuel flow from the second flow path 22 toward the outside of the fuel pump 1 without drawing the fuel from the outside of the third flow path 23. Therefore, the vapor discharge hole 20 according to the first embodiment can increase the vapor discharge amount discharged from the lower fuel flow channel 18 as compared with the vapor discharge hole 200 in the comparative example.

Subsequently, the control of the fuel pump 1 according to this embodiment will be described with reference to a flowchart of FIG. 9.

The control of the fuel pump 1 starts together with the start of an engine. When the control starts, the ECU 5 determines the rotation speed of the motor part 30 according to a target fuel pressure required by the internal combustion engine 4, and supplies an electric power to the motor part 30 of the fuel pump 1 through the FPC 6. In the fuel pump 1 according to this embodiment, the rotation speed of the motor part 30 matches the impeller rotation speed.

In S1, the ECU 5 detects the fuel pressure which is a pressure of the fuel discharged from the fuel pump 1 according to a signal from the pressure sensor 7.

Subsequently, in S2, the ECU 5 executes a feedback control controlling the rotation speed of the motor part 30 in the fuel pump 1 under a proportional integral control (PI control) so that the target fuel pressure matches the fuel pressure detected by the pressure sensor 7.

Subsequently, in S3, the ECU 5 detects whether the vapor is generated in the fuel of the pump chamber 16 of the fuel pump 1, or not, on the basis of the fuel pressure detected by the pressure sensor 7.

In general, the vapor is generated due to the intake negative pressure in the vicinity of the intake port 12, and prevents the fuel pressure from being boosted. Thus, a generation of the vapor can be detected on the basis of a reduction in the fuel pressure discharged by the fuel pump 1.

When the fuel pressure is reduced more than a predetermined threshold, the ECU 5 determines that the vapor is generated in the fuel of the pump chamber 16. The predetermined threshold is set to, for example, 10 kPa.

When it is determined in S3 that no vapor is generated, the ECU 5 returns to S1, and continues the feedback control.

On the other hand, when it is determined in S3 that the vapor is generated, the ECU 5 proceeds to S4, and switches the control of the fuel pump 1 to a feed forward control in order to discharge the vapor in the pump chamber 16 toward the vapor discharge hole 20.

In S4, the ECU 5 increases an increase rate of the rotation speed of the motor part 30, and supplies the electric power to the motor part 30 through the FPC 6. In S5, the ECU 5 detects whether a predetermined time elapses, or not, and maintains the increase rate of the rotation speed executed in S4 until the predetermined time elapses.

When the predetermine time elapses in S5, the ECU 5 again returns to S1, and executes the feedback control.

In S2 described above, when the ECU 5 and the FPC 6 according to this embodiment executes the feedback control on the fuel pump 1, those components function as a normal control unit.

In S3 described above, the pressure sensor 7 and the ECU 5 according to this embodiment function as a detection unit.

In S4 and S5 described above, when the ECU 5 and the FPC 6 according to this embodiment execute a predetermined feed forward control on the fuel pump 1, those components function as a vapor control unit.

Figure 10:
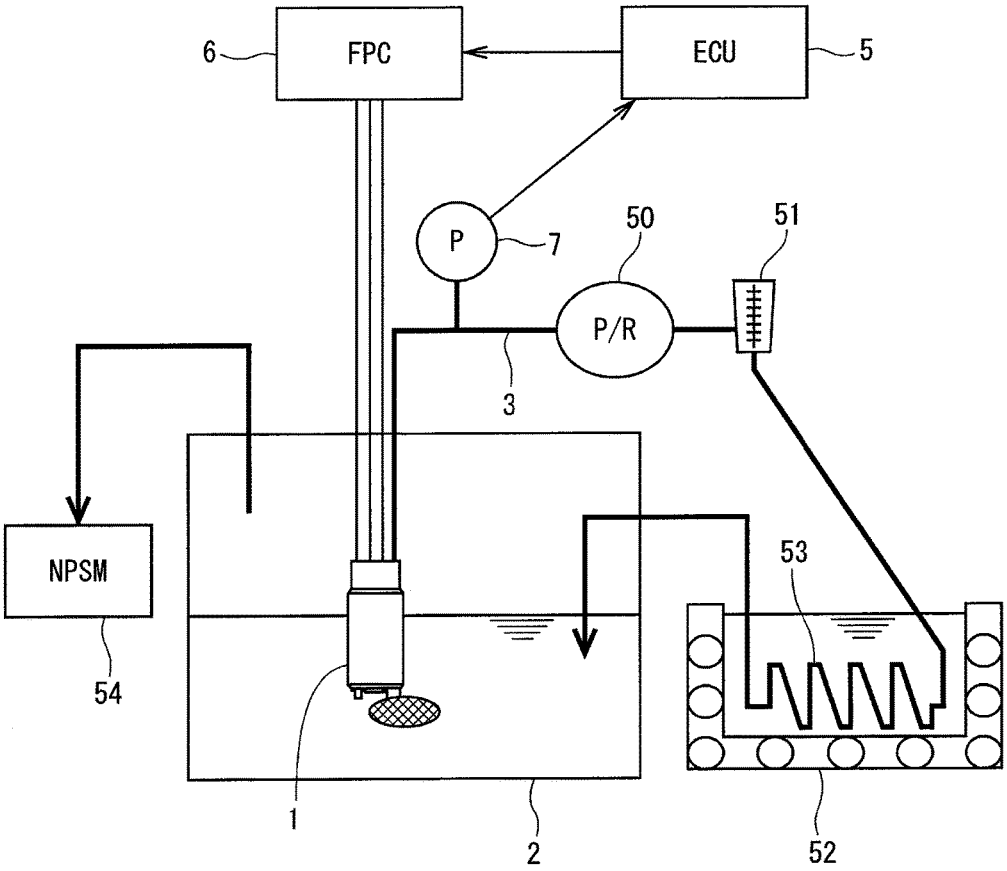
FIG. 10 is a configuration diagram of an evaluation test of the fuel pump according to the first embodiment.

FIG. 10 illustrates a configuration used for an evaluation test related to the control of the fuel pump 1 described above.

The fuel discharged from the fuel pump 1 passes through a pressure regulator (P/R) 50, and a flow rate of the fuel is measured by a flowmeter 51. Thereafter, the fuel is heated to a predetermined temperature by a heat exchange pipe 53 in a heat exchanger 52, and returns to the fuel tank 2. An air pressure in the fuel tank 2 is set to a predetermined air pressure by a negative pressure suction machine (NPSM) 54. As a result, the same state as a state in which the fuel pump 1 installed in the vehicle is used under environments of a high temperature and a low pressure is produced.

Figure 11:
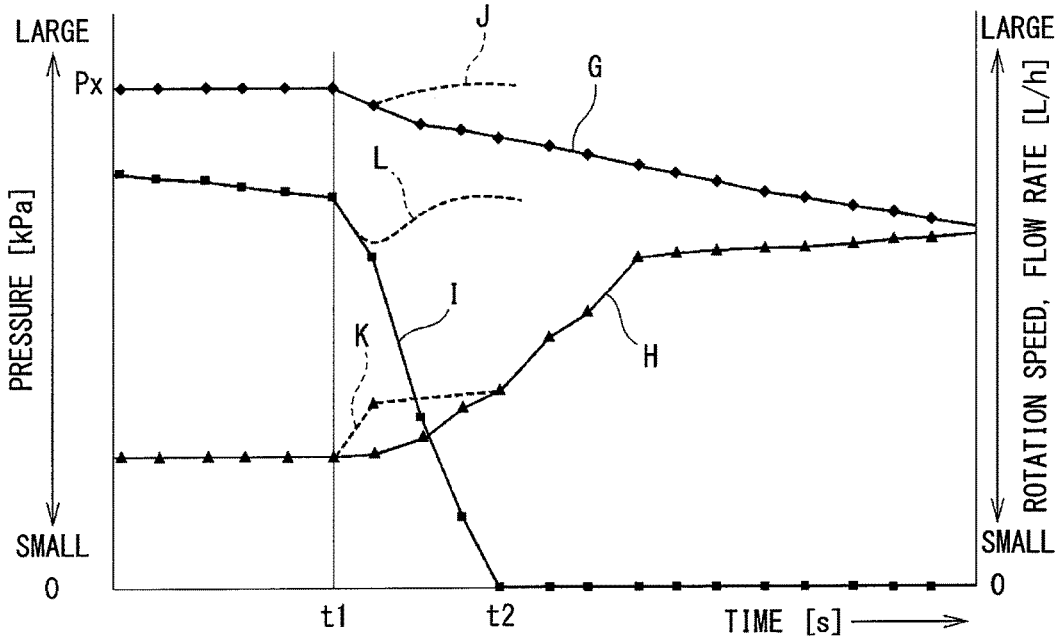
FIG. 11 is a diagram illustrating test data in the evaluation test of FIG. 10.

FIG. 11 is a diagram illustrating test data when the fuel pump 1 is driven in the configuration of FIG. 10. The ECU 5 drives the fuel pump 1 so as to maintain the pressure of the fuel discharged from the fuel pump 1 at a predetermined pressure Px.

Referring to FIG. 11, respective sold lines G, H, and I are test data when the fuel pump 1 is driven under a conventional control. The conventional control means a control in which the ECU 5 executes only the above-mentioned feedback control (S1), but does not execute the above-mentioned predetermined feed forward control (S4, S5). The solid line G indicates a fuel pressure, the solid line H indicates an impeller rotation speed, and the solid line I indicates a flow rate.

Figure 9:
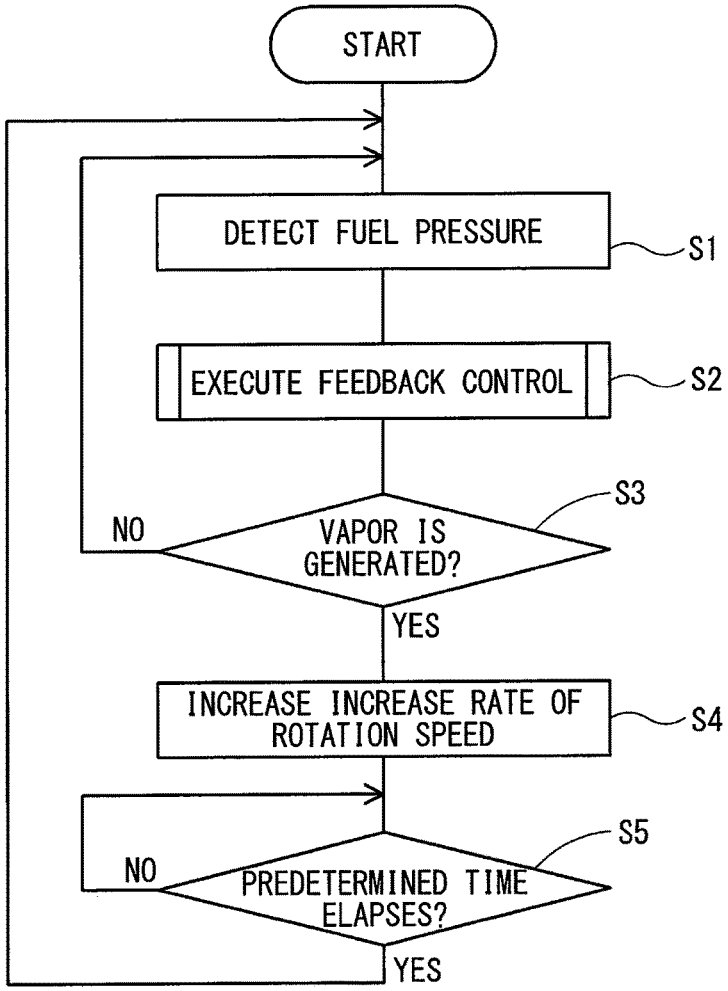
FIG. 9 is a flowchart of a control of a fuel pump according to the first embodiment.

On the other hand, the respective dashed lines J, K, and L are target values when the ECU 5 performs both of the feedback control (S1) and a predetermined feed forward control (S4, S5) under the control of this embodiment described in the flowchart of FIG. 9. The dashed line J indicates a fuel pressure, the dashed line K indicates an impeller rotation speed, and the dashed line L indicates a flow rate.

When the fuel pump 1 is driven under the conventional control, the fuel pressure indicated by the solid line G decreases regardless of the feedback control (S1) of the ECU 5 after a time t1. As a result, at the time t1, it is said that vapor is generated in the fuel in the pump chamber 16 of the fuel pump 1.

After the time t1, the rotation speed indicated by the solid line H rises under the feedback control of the ECU 5. However, both of the fuel pressure indicated by the solid line G and the flow rate indicated by the solid line I decrease, and at a time t2, the flow rate becomes 0, and the fuel pump 1 becomes in a vapor locked state.

Figure 12:
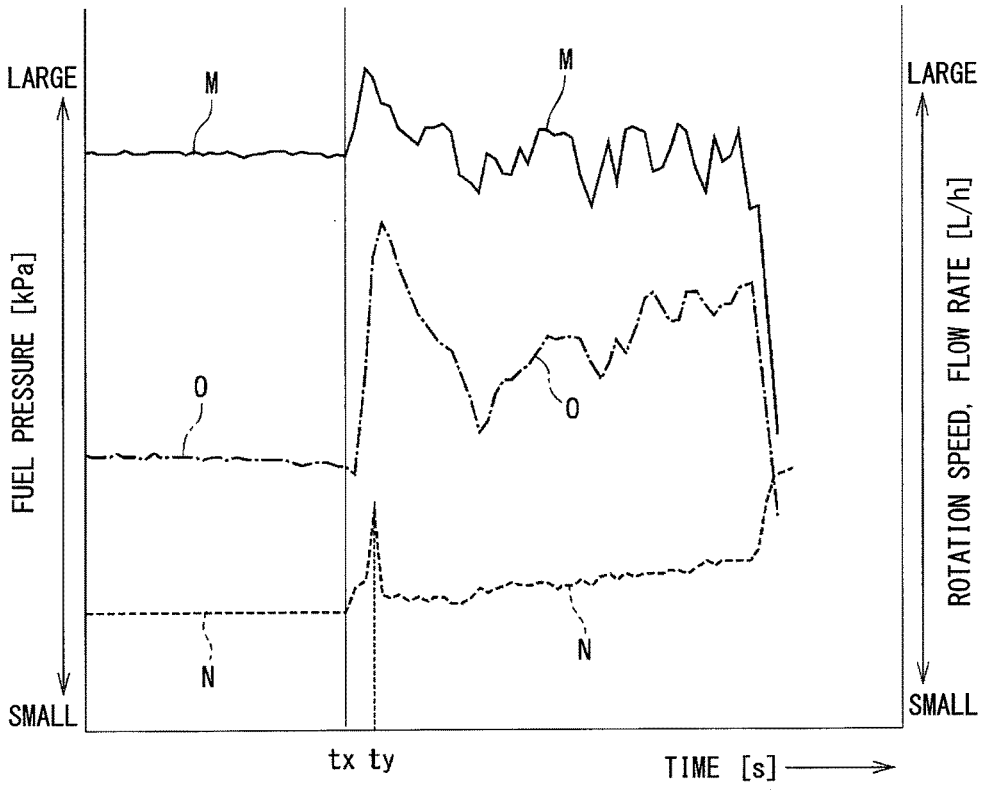
FIG. 12 is a diagram illustrating test data when the control of FIG. 9 is performed in the evaluation test of FIG. 10.

On the other hand, test data shown in FIG. 12 is obtained when the ECU 5 performs both of the feedback control (S1) and the predetermined feed forward control (S4, S5) under the control of this embodiment as described in the flow chart of FIG. 9.

A solid line M indicates a fuel pressure, a dashed line N indicates an impeller rotation speed, and a chain line O indicates a flow rate.

Upon the detection of the generation of the vapor at a time tx, the ECU 5 switches the control of the fuel pump 1 from the feedback control (S1) to the predetermined feed forward control (S4, S5). In other words, as indicated by the dashed line N, the ECU 5 increases the increase rate of the rotation speed to rapidly increase the rotation speed only between the time tx and a time ty.

As a result, as indicated by the solid line M, the fuel pressure maintains a value close to the target fuel pressure although the fuel pressure pulses. As indicated by the chain line O, the flow rate discharged from the fuel pump 1 is maintained.

Figure 13:
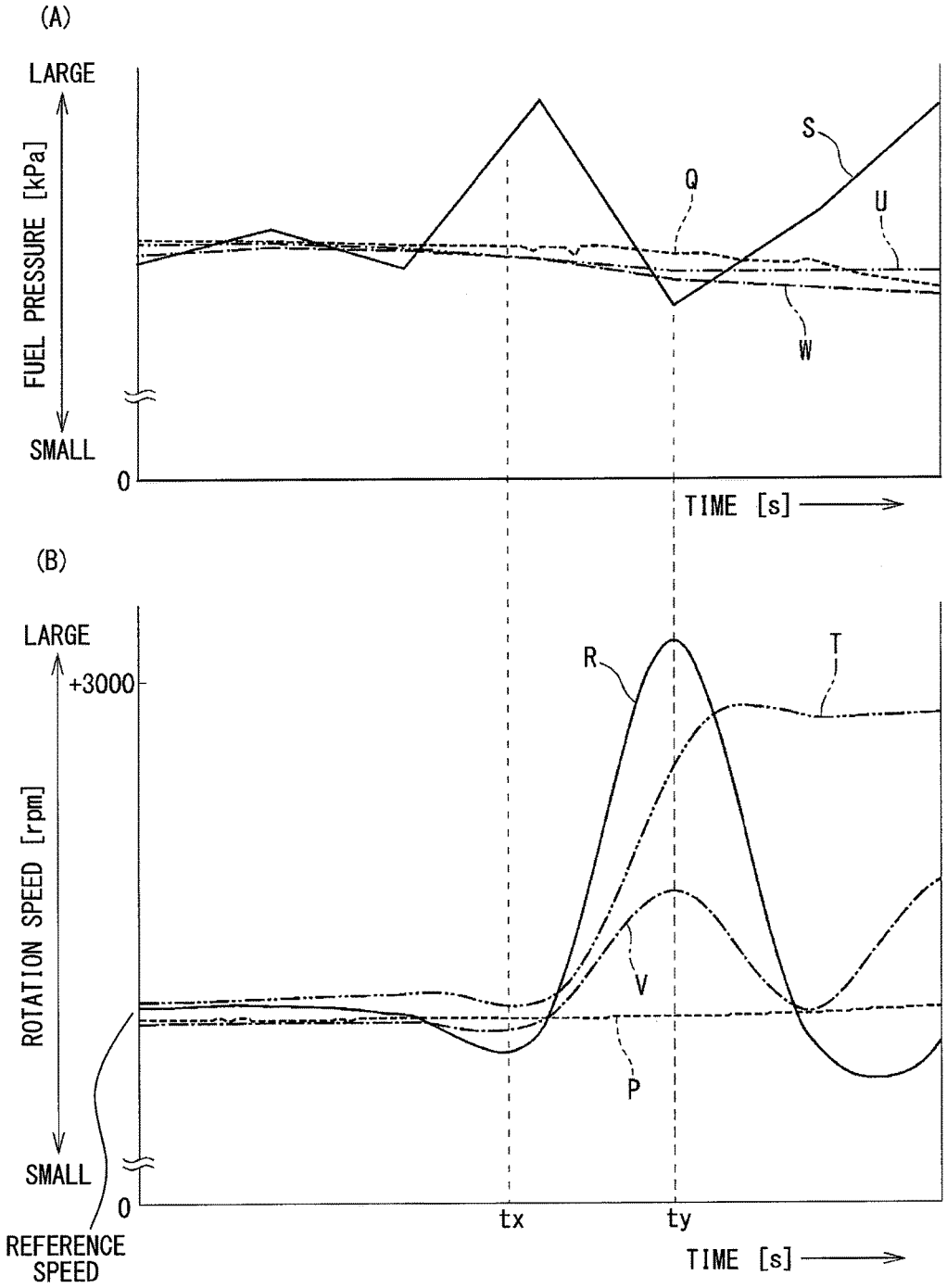
FIG. 13 is a diagram illustrating test data when changing an increase rate of an impeller rotation speed at the time of vapor generation.

FIG. 13 illustrates test data in changing the increase rate of the impeller rotation speed when the vapor is generated in the pump chamber 16.

FIG. 13(A) illustrates a change in the fuel pressure, and FIG. 13(B) illustrates a change in the increase rate of the impeller rotation speed.

Dashed lines P and Q represent test data when the ECU 5 performs the conventional control. In the dashed line P, when the fuel pressure discharged from the fuel pump 1 is reduced to, for example, 10 kPa which is a threshold of the vapor generation detection, the ECU 5 sets the increase rate of the impeller rotation speed to 1000 rpm/s under the feedback control. In this case, the fuel pressure continues to decrease as indicated by the dashed line Q.

Each of solid lines R, S, two-dot chain lines T, U, and chain lines V, W represents test data when the ECU 5 performs the feedback control (S1) and the feed forward control (S4, S5) as described in the flowchart of FIG. 9.

In the solid line R, when the vapor is generated in the pump chamber 16, the ECU 5 sets the increase rate of the impeller rotation speed to 30000 rpm/s for only 0.1 seconds from the time tx to the time ty. In this case, as indicated by the solid line S, the fuel pressure maintains a value close to the target fuel pressure although the fuel pressure pulses.

A time (from time tx to time ty) during which the increase rate of the impeller rotation speed is maintained can be arbitrarily set by experiment. In this embodiment, the time from tx to ty is set to 0.1 seconds, but this time may be set to be shorter or longer than 0.1 seconds, for example, according to a body type of the fuel pump 1.

In the two-dot chain line T, when the vapor is generated in the pump chamber 16, the ECU 5 sets the increase rate of the impeller rotation speed to 20000 rpm/s. In this case, as indicated by the two-dot chain line U, the fuel pressure gently increases.

In the chain line V, when the vapor is generated in the pump chamber 16, the ECU 5 sets the increase rate of the impeller rotation speed to 10000 rpm/s. In this case, the fuel pressure decreases as indicated by the dashed line W.

Figure 14:
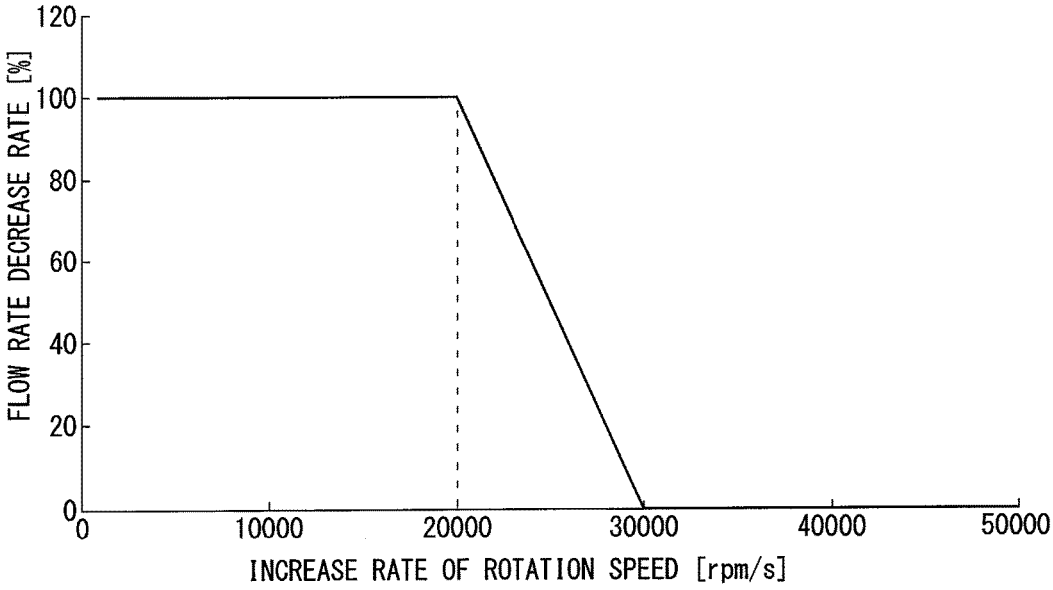
FIG. 14 is a characteristic diagram of the increase rate of the impeller rotation speed at the time of vapor generation and a flow rate decrease rate.

FIG. 14 collects up of the test data shown in FIG. 13.

When the vapor is generated in the pump chamber 16, when the ECU 5 sets the increase rate of the impeller rotation speed to a value higher than or equal to 20000 rpm/s, a decrease rate of the flow rate discharged by the fuel pump 1 is reduced. When the increase rate of the impeller rotation speed is set to 30000 rpm/s, the decrease rate of the flow rate discharged by the fuel pump 1 becomes 0.

The increase rate of the impeller rotation speed that is 20000 rpm/s is 20 times as large as the increase rate of the impeller rotation speed that is 1000 rpm/s under the feedback control. Therefore, when the vapor is generated in the pump chamber 16, when the ECU 5 sets the increase rate of the impeller rotation speed to a value higher than or equal to 20 times as large as the increase rate of the impeller rotation speed under the feedback control, the decrease rate of the flow rate discharged by the fuel pump 1 is reduced.

Figure 15:
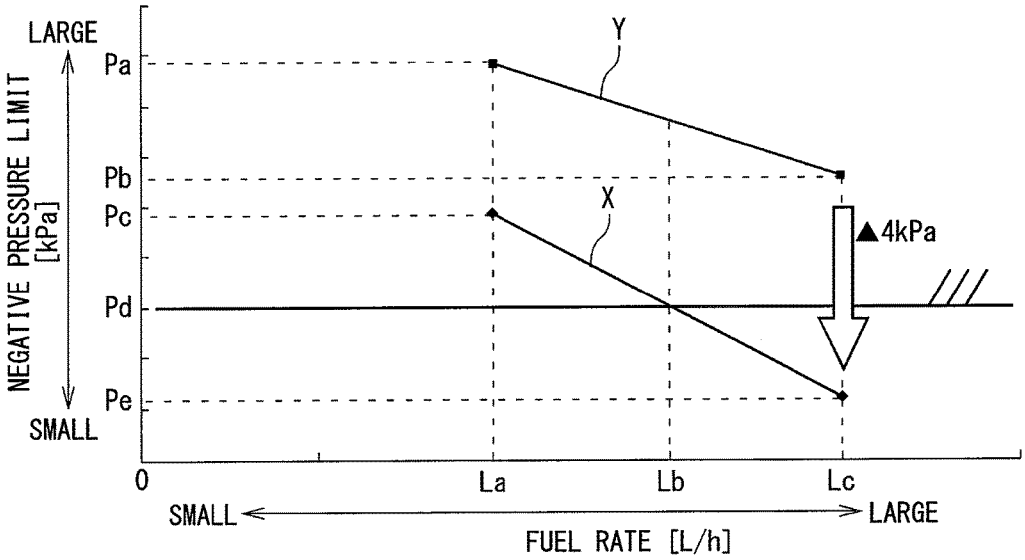
FIG. 15 is a characteristic diagram between a negative pressure limit and a flow rate in the fuel pump according to the first embodiment and a conventional fuel pump.

A solid line X in FIG. 15 is data indicative of a relationship between a negative pressure limit and a flow rate when the ECU 5 drives the fuel pump 1 under the control of this embodiment.

A solid line Y in FIG. 15 is data indicative of a relationship between a negative pressure limit and a flow rate when the ECU 5 drives the fuel pump 1 under the conventional control.

A negative pressure limit Pe of a flow rate Lc in the solid line X is lower than a negative pressure limit Pb of the flow rate Lc in the solid line Y by a value higher than or equal to 4 kPa. Therefore, the fuel pump 1 under the control of this embodiment as indicated by the solid line X can decrease the negative pressure limit by a value higher than or equal to 4 kPa in the predetermined flow rate Lc as compared with the fuel pump 1 under the conventional control indicated by the solid line Y. In other words, the fuel pump 1 under the control of this embodiment can reduce the flow rate under a low pressure condition.

The fuel pump 1 according to this embodiment has the following advantageous effects.

(1) In this embodiment, when the vapor is generated in the pump chamber 16, the impeller rotation speed is set to be higher than the rotation speed under the normal control for a predetermined time with the result that the vapor in the pump chamber 16 is discharged into the vapor discharge hole 20.

In other words, when the vapor is generated in the pump chamber 16, the control of the fuel pump 1 switches from the feedback control that is normal to the feed forward control discharging the vapor into the vapor discharge hole 20. Thus, the vapor in the pump chamber 16 is surely discharged to the outside of the fuel pump 1 from the vapor discharge hole 20. Therefore, the fuel pump 1 can discharge a required flow rate without any vapor lock.

(2) In this embodiment, when the generation of the vapor is detected, the increase rate of the impeller rotation speed is set to a value higher than or equal to 20000 rpm/s.

With the above configuration, the vapor lock of the fuel pump 1 can be surely prevented.

(3) In this embodiment, when the generation of the vapor is detected due to a reduction in the fuel pressure, the increase rate of the impeller rotation speed under the feed forward control is set to a value higher than or equal to 20 times as large as the increase rate of the impeller rotation speed under the feedback control corresponding to the reduction in the fuel pressure.

With the above configuration, the vapor lock of the fuel pump 1 can be surely prevented.

(4) In this embodiment, when the generation of the vapor is detected, the impeller rotation speed is subjected to the feed forward control for only a period of time required for the vapor discharge.

As described above, the fuel pump 1 discharges only the flow rate required for the discharge of the vapor under the feed forward control for a short period time, and is restrained from discharging a larger amount of flow rate.

(5) In this embodiment, when the generation of the vapor is detected, the feedback control of the motor part 30 is switched to the predetermined feed forward control.

With the above configuration, the vapor in the pump chamber 16 can be surely discharged.

(6) In this embodiment, after the feed forward control is executed for only a predetermined period of time, the feed forward control is switched to the feedback control.

With the above configuration, with the execution of the feed forward control for only an extremely short period of time, the fuel pump 1 discharges only the flow rate required for the discharge of the vapor, and is restrained from discharging a larger amount of flow rate.

(7) In this embodiment, it is detected that the vapor is generated when the pressure of the fuel discharged from the discharge port 17 is reduced from the target pressure by a value higher than or equal to a predetermined pressure.

In a normal state, since the motor part 30 of the fuel pump 1 is subjected to the feedback control to the rotation speed corresponding to the target pressure, the fuel pressure discharged by the fuel pump 1 in the normal state is maintained at the target pressure. Thus, when the fuel pressure discharged by the fuel pump 1 is reduced from the target pressure by a value higher than or equal to the predetermined pressure, it can be presumed that the vapor is generated in the pump chamber 16.

(8) In this embodiment, the vapor discharge hole 20 includes the first flow path 21 having the inner diameter larger than that of the second flow path 22 which is placed at a position closer to the lower fuel flow channel 18 than the second flow path 22 is. Further, the vapor discharge hole 20 has the tapered part 24 in the connection portion of the first flow path 21 and the second flow path 22.

With the above configuration, the fuel flowing in the lower fuel flow channel 18 rapidly flows along the inner walls of the first flow path 21, the tapered part 24, and the second flow path 22 without being away from the inner wall of an upstream end of the vapor discharge hole 20. Thus, the fuel can flow in all of the flow paths in the vapor discharge hole 20 without any vortex flow of the fuel generated inside of the inner wall of the first flow path 21. Therefore, since the vapor in the lower fuel flow channel 18 is surely discharged from the vapor discharge hole 20, the vapor lock of the fuel pump 1 can be prevented.

(9) In this embodiment, the first flow path 21, the second flow path 22, and the tapered part 24 are disposed coaxially with each other.

With the above configuration, the fuel flowing in the lower fuel flow channel 18 rapidly flows into the tapered part 24 and the second flow path 22 from the first flow path 21.

(10) In this embodiment, the relationship between the length L of the first flow path 21 and the inner diameter d of the first flow path 21 satisfies $2 \leq d/L \leq 5$.

With the above configuration, when the impeller rotation speed is set to, for example, 3000 to 10000 rpm, the shape of the first flow path 21 can be adjusted to the angle of the fuel flowing from the lower fuel flow channel 18 into the second flow path 22 through the first flow path 21. Therefore, the amount of fuel flowing from the lower fuel flow channel 18 into the vapor discharge hole 20 can be maximized in a range of $2 \leq d/L \leq 5$.

(11) In this embodiment, the vapor discharge hole 20 has the third flow path 23 larger in the inner diameter than the second flow path 22 on the end of the second flow path 22 opposite to the first flow path.

With the above configuration, an appropriate flow rate can be discharged from the lower fuel flow channel 18 without lengthening the second flow path 22 forming a fuel throttle portion more than necessary.

(12) In this embodiment, the inner wall of the third flow path 23 is tapered to provide a draft through which a mold that defines the third flow path 23 is removed from a material of the lower casing 14 in a case where the lower casing 14 is being formed.

As a result, the workability of the third flow path 23 can be enhanced. In forming the vapor discharge hole 20, burr generated in a connection portion between the second flow path 22 and the third flow path 23 can be easily removed.

With a reduction in the taper angle of the third flow path 23, the fuel can be prevented from being drawn into the third flow path 23 from the outside of the lower casing 14. Therefore, the discharge amount of the vapor from the vapor discharge hole 20 can increase.

(13) In this embodiment, the first flow path 21 of the vapor discharge hole 20 is connected to the inner curved part 183 disposed on the radially inner side of the lower fuel flow channel 18.

Since a centrifugal force caused by the rotation of the impeller 11 acts on the fuel flowing through the lower fuel flow channel 18, a pressure of the fuel flowing in the radially outer side of the lower fuel flow channel 18 is high. Thus, since the vapor contained in the fuel is smaller in mass than the fuel, the vapor flows in the radially inner side of the lower fuel flow channel 18. Therefore, with the connection of the first flow path 21 of the vapor discharge hole 20 to the inner curved part 183 of the lower fuel flow channel 18, the vapor flowing in the lower fuel flow channel 18 can be surely introduced into the vapor discharge hole 20.

(Second Embodiment)

Figure 16:
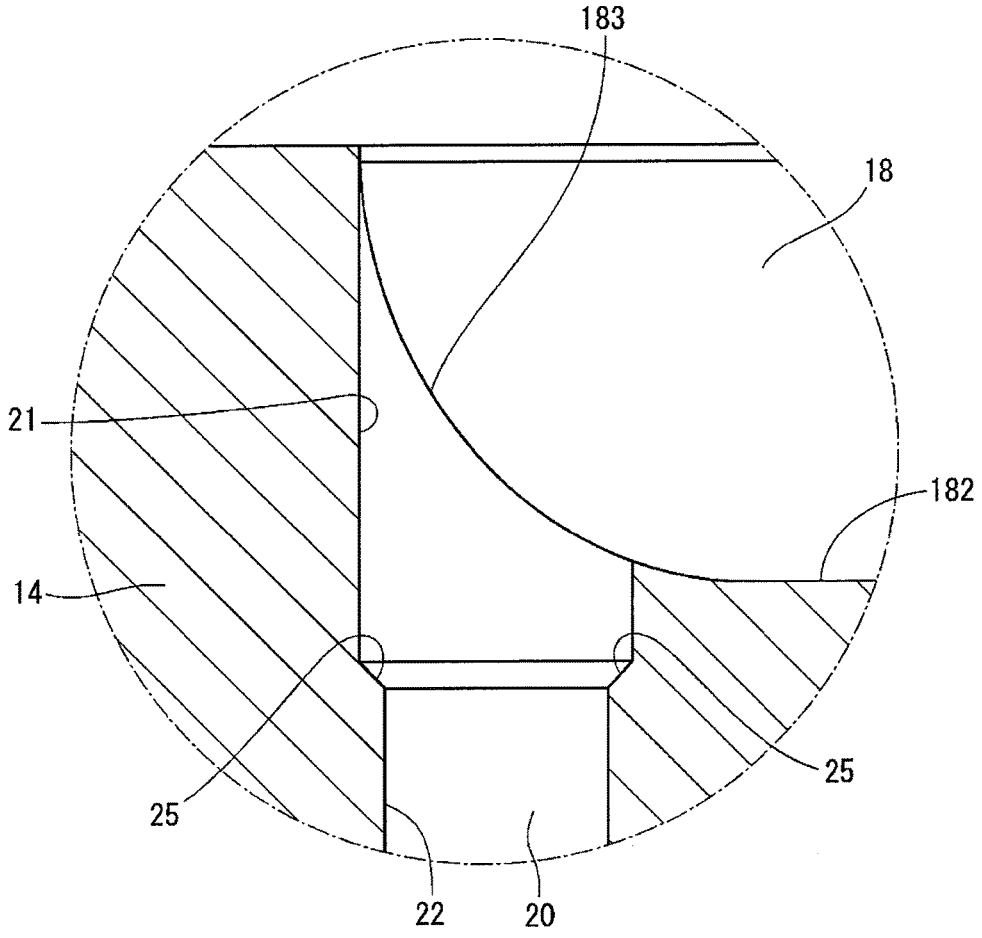
FIG. 16 is an enlarged view of a vapor discharge hole of a fuel pump according to a second embodiment.

An enlarged view of a fuel pump according to a second embodiment is illustrated in FIG. 16. In the following multiple embodiments, the same reference numerals are given to configurations which are substantially the same as those in the above-described first embodiment, and description thereof will be omitted.

In the second embodiment, in the vapor discharge hole 20, an inner periphery of a radially inner side of a tapered part 25 is connected to an inner periphery of a fuel flow path side of a second flow path. Therefore, in the second embodiment, there is no step between the first flow path 21 and the second flow path 22.

Similarly, in the second embodiment, the tapered part 25 prevents a vortex flow from being generated in a fuel flowing from the first flow path 21 into the second flow path 22. Thus, the fuel can flow in all of the flow paths of the vapor discharge hole 20, and the vapor in the lower fuel flow channel 18 can be surely discharged from the vapor discharge hole 20.

(Third Embodiment)

Figure 17:
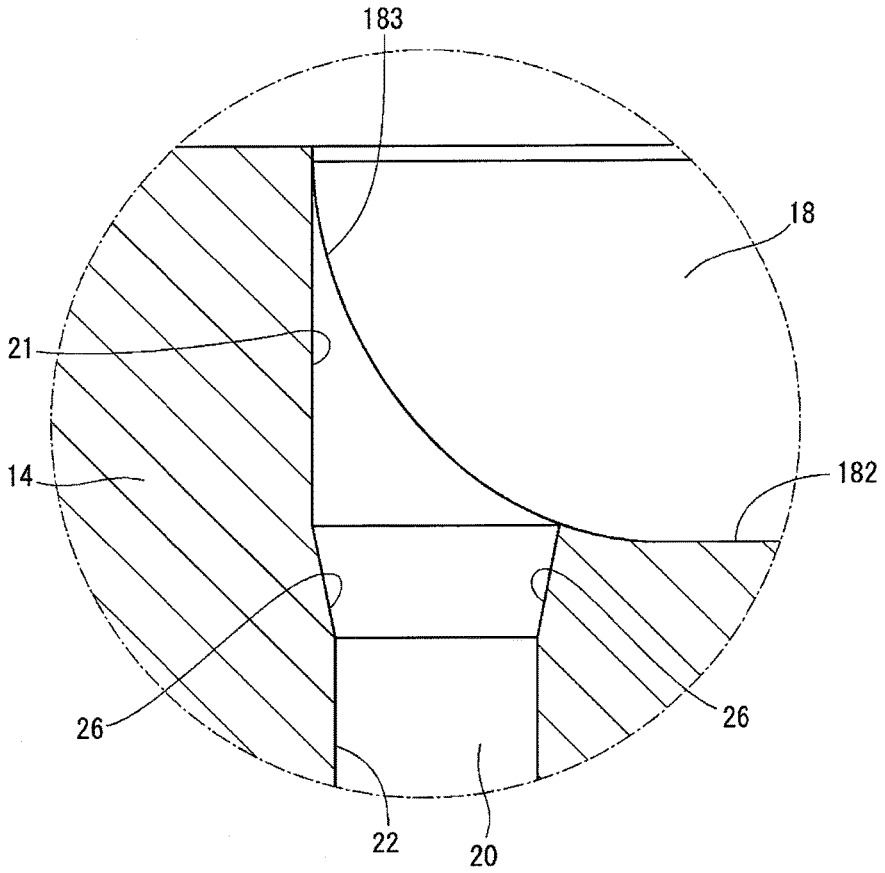
FIG. 17 is an enlarged view of a vapor discharge hole of a fuel pump according to a third embodiment.

An enlarged view of a fuel pump according to a third embodiment is illustrated in FIG. 17. In the third embodiment, a tapered part 26 of the vapor discharge hole 20 is connected to the lower fuel flow channel 18.

Similarly, in the third embodiment, there is no step between the first flow path 21 and the second flow path 22, a vortex flow is prevented from being generated in a fuel flowing from the first flow path 21 or the tapered part 26 into the second flow path 22. Thus, the vapor in the lower fuel flow channel 18 can be surely discharged from the vapor discharge hole 20.

(Other Embodiments)

(1) In the above-mentioned embodiments, the fuel pump used for the variable fuel pressure system has been described. On the contrary, in another embodiment, a fuel pump can be used for another fuel supply system.

(2) In the above-mentioned embodiments, the fuel pump having the brushless motor has been described. On the contrary, in another embodiment, the fuel pump may have a motor with a brush.

(3) In the above-mentioned embodiments, the ECU detects whether the vapor is generated, or not, on the basis of the fuel pressure detected by the pressure sensor. On the contrary, in another embodiment, the ECU may detect whether the vapor is generated, or not, on the basis of a change in the flow rate, a relationship between the fuel pressure and a fuel temperature, and a variation rate of the fuel pressure.

(4) In the above-mentioned embodiments, the vapor discharge hole has the first flow path, the second flow path, the third flow path, and the tapered part. On the contrary, in another embodiment, the vapor discharge hole may have no third flow path, and the second flow path may be opened directly in an outer wall of the lower casing 14.

The present disclosure is not limited to the embodiments mentioned above, and can be applied to various embodiments within the spirit and scope of the present disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A fuel pump, comprising:

an impeller having a plurality of vane grooves in a peripheral direction;

a motor part rotating the impeller;

a casing having an upper portion and a lower portion and having a pump chamber rotatably housing the impeller;

an intake port introducing a fuel from an outside of the casing into the pump chamber;

a discharge port discharging the fuel from the pump chamber to the outside of the casing;

a fuel flow channel being provided in the casing to be an annular shape corresponding to the vane grooves of the impeller so as to extend from the intake port to the discharge port;

a vapor discharge hole defined in the lower portion of the casing and through which the vapor can be discharged from the fuel flow channel toward the outside of the casing;

a detection unit detecting a generation of the vapor in the pump chamber and the fuel flow channel;

a normal control unit controlling the motor part to adjust a rotation speed of the impeller to a rotation speed corresponding to a target fuel pressure when the detection unit does not detect the generation of the vapor; and a vapor control unit setting the rotation speed of the impeller to be higher than the target rotation speed determined by the normal control unit for a predetermined time to discharge the vapor in the pump chamber and the fuel flow channel to the vapor discharge hole when the detection unit detects the generation of the vapor.

2. The fuel pump according to claim 1, wherein the vapor control unit sets an increase rate of the rotation speed of the impeller to a value higher than or equal to 20000 rpm/s.

3. The fuel pump according to claim 1, wherein the vapor control unit controls the rotation speed of the impeller for only a time required for the vapor discharge when the detection unit detects the generation of the vapor.

4. The fuel pump according to claim 1, wherein when the detection unit detects the generation of the vapor, the detection unit switches a feedback control of the motor part which is performed by the normal control unit to a feed forward control which is performed by the vapor control unit.

5. The fuel pump according to claim 4, wherein the vapor control unit switches the feed forward control to the feedback control by the normal control unit, after the vapor control unit executes the feed forward control for a predetermined time.

6. The fuel pump according to claim 1, wherein the detection unit detects the generation of the vapor when a pressure of the fuel discharged from the discharge port is reduced from a target pressure by a value higher than or equal to a predetermined pressure.

7. The fuel pump according to claim 1, wherein the vapor discharge hole includes:

a first flow path communicating with the fuel flow channel;

a second flow path having an inner diameter smaller than that of the first flow path, and communicating with an end of the first flow path opposite to the fuel flow channel; and a tapered part being disposed in a connection portion between the first flow path and the second flow path.

8. The fuel pump according to claim 7, wherein the first flow path, the second flow path, and the tapered part are disposed coaxially with each other.

9. The fuel pump according to claim 7, wherein when a distance from a connection position of the fuel flow channel and the first flow path to a connection position of the first flow path and the second flow path is L and the inner diameter of the first flow path is d, $2 \leq d/L \leq 5$ is satisfied.

10. The fuel pump according to claim 7, wherein the vapor discharge hole further includes a third flow path communicating with an end of the second flow path opposite to the first flow path, and the third flow path has an inner diameter larger than the inner diameter of the second flow path.

11. The fuel pump according to claim 10, wherein the third flow path has an inner wall that is tapered to provide a draft through which a mold that defines the third flow path is removed from a material of the casing when the casing is being formed.

12. A control method for the fuel pump according to claim 1, comprising:

detecting the generation of the vapor in the pump chamber and the fuel flow channel;

controlling the motor part to adjust the rotation speed of the impeller to the rotation speed corresponding to the target fuel pressure when the detection unit does not detect the generation of the vapor; and setting the rotation speed of the impeller to be higher than the target rotation speed determined by the normal control unit for a predetermined time to discharge the vapor in the pump chamber and the fuel flow channel to the vapor discharge hole when the detection unit detects the generation of the vapor.

13. A fuel pump, comprising:

an impeller having a plurality of vane grooves in peripheral direction;

a motor part rotating the impeller;

a casing having a pump chamber rotatably housing the impeller;

an intake port introducing a fuel from an outside of the casing into the pump chamber;

a discharge port discharging the fuel from the pump chamber to the outside of the casing;

a fuel flow channel being provided in the casing to be an annular shape corresponding to the vane grooves of the impeller so as to extend from the intake port to the discharge port;

a vapor discharge hole through which the vapor can be discharged from the fuel flow channel toward the outside of the casing;

a detection unit detecting a generation of the vapor in the pump chamber and the fuel flow channel;

a normal control unit controlling the motor part to adjust a rotation speed of the impeller to a rotation speed corresponding to a target fuel pressure when the detection unit does not detect the generation of the vapor; and a vapor control unit setting the rotation speed of the impeller to be higher than the target rotation speed determined by the normal control unit for a predetermined time to discharge the vapor in the pump chamber and the fuel flow channel to the vapor discharge hole when the detection unit detects the generation of the vapor, wherein the normal control unit executes a feedback control controlling the rotation speed of the impeller to become a rotation speed corresponding to the target fuel pressure, and the vapor control unit sets an increase rate of the rotation speed of the impeller to a value higher than or equal to 20 times as large as the increase rate of the rotation speed of the impeller which is determined by the normal control unit according to a reduction in a fuel pressure that is a pressure of the fuel.

14. A fuel pump, comprising:

an impeller having a plurality of vane grooves in a peripheral direction;

a motor part rotating the impeller;

a casing having a pump chamber rotatably housing the impeller;

an intake port introducing a fuel from an outside of the casing into the pump chamber;

a discharge port discharging the fuel from the pump chamber to the outside of the casing;

a fuel flow channel being provided in the casing to be an annular shape corresponding to the vane grooves of the impeller so as to extend from the intake port to the discharge port;

a vapor discharge hole through which the vapor can be discharged from the fuel flow channel toward the outside of the casing;

a detection unit detecting a generation of the vapor in the pump chamber and the fuel flow channel;

a normal control unit controlling the motor part to adjust a rotation speed of the impeller to a rotation speed corresponding to a target fuel pressure when the detection unit does not detect the generation of the vapor; and a vapor control unit setting the rotation speed of the impeller to be higher than the target rotation speed determined by the normal control unit for a predetermined time to discharge the vapor in the pump chamber and the fuel flow channel to the vapor discharge hole when the detection unit detects the generation of the vapor; wherein:

the vapor discharge hole includes:

a first flow path communicating with the fuel flow channel;

a second flow path having an inner diameter smaller than that of the first flow path, and communicating with an end of the first flow path opposite to the fuel flow channel; and a tapered part being disposed in a connection portion between the first flow path and the second flow path;

the fuel flow channel includes:

an outer curved part becoming gradually deeper from a radially outer side toward a radially inner side;

a flat part being disposed on the radially inner side of the outer curved part, and having a depth that is kept constant; and an inner curved part being disposed on a radially inner side of the flat part, and becoming gradually shallower from the flat part toward the radially inner side, and the first flow path of the vapor discharge hole is connected to the inner curved part.

* * * * *